US006241250B1

(12) United States Patent
Webb

(10) Patent No.: US 6,241,250 B1
(45) **Date of Patent: *Jun. 5, 2001**

(54) METHOD AND APPARATUS FOR PLAYING A GAME WITH NUMERICAL RESULT

(75) Inventor: Derek J. Webb, Derby (GB)

(73) Assignee: Prime Table Games LLC, Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/389,480

(22) Filed: Sep. 3, 1999

Related U.S. Application Data

(63) Continuation-in-part of application No. 09/351,330, filed on Jul. 12, 1999.

(51) Int. Cl.[7] ..... A63F 1/00
(52) U.S. Cl. ..... 273/292; 273/303; 273/274
(58) Field of Search ..... 273/292, 274, 273/303; 463/12, 13

(56) References Cited

U.S. PATENT DOCUMENTS 5,362,064 * 11/1994 Lofink .
5,395,119 * 3/1995 Jacob .
5,529,309 6/1996 Bartlett .

* cited by examiner

*Primary Examiner*—Benjamin H. Layno
*Assistant Examiner*—V K Merderatta
(74) *Attorney, Agent, or Firm*—Nixon & Vanderhye P.C.

(57) ABSTRACT

A Baccarat derivation incorporates an adjustable house advantage while eliminating confusing card-drawing rules, resulting in a more exciting and playable game. A table layout includes betting areas for a competition wager that one side or the other will win the game as well as a proposition wager area that the sides will tie. As with conventional Baccarat, the players can wager for either side. The methodology is suited for any game where a result is determined according to ranked values such as Baccarat, Blackjack, War or Dice.

28 Claims, 2 Drawing Sheets

METHOD AND APPARATUS FOR PLAYING A GAME WITH NUMERICAL RESULT

This application is a continuation-in-part of U.S. patent application Ser. No. 09/351,330, filed Jul. 12, 1999.

BACKGROUND OF THE INVENTION

The present invention relates to casino games and gaming formats and, more particularly, to betting options and modified versions of existing games where a result is determined according to ranked values.

Baccarat is played internationally with different rules and different names, such as Punto Banco and Chemin-de-Fer. In the U.S., Baccarat is typically played in a dedicated VIP high-stakes gaming area. In an effort to increase the popularity of the game, smaller versions of Baccarat such as Mini-Baccarat have been introduced in the regular gaming area.

There are several drawbacks associated with conventional Baccarat. In particular, in certain situations, the house takes a commission on wagers. Although the house needs an advantage, the use of commission can deter many players. Moreover, from a casino perspective, calculating commissions slows down the game. To correct this, the game may be operated where the commission is collected not after each hand, but at the end of each shoe (a shoe holds multiple decks of cards from which hands are dealt by the dealer), prior to reshuffling the decks. While this speeds up the game, collection of commission may be impacted by the player running out of funds or not wishing to meet the obligation.

Moreover, for novice players, the rules of play seem obscure, and the procedure is prone to error. In Baccarat, there is a player hand and a banker hand, but the casino player may bet either hand. Each hand receives two cards with 10's and face cards counting as zero. The superior hand is the higher hand, with 9 being the highest total and with each hand being allowed to draw a third card in certain circumstances. The card draw option to the player hand is determined by the player two-card total, and the card draw option to the banker hand is determined by the banker two-card total and the exact third card drawn by the player. With these rules, although the game is simple in its concepts, the game has a complicated appearance.

Still further, with conventional Baccarat, there is an inherent hand-value deterioration bias. That is, a two-card total of 5 improves with a 1, 2, 3 or 4 value card, but deteriorates with a 5, 6, 7, 8 or 9 value card, which creates the inherent bias.

Additionally, as a tie is a push with respect to wagers, there is no casino advantage working on the player and banker wagers when a tie occurs. If the tie outcome could be incorporated into the outcome of the basic wager, the house advantage could be manipulated as desired.

In one modified version of Baccarat, so called Bahama Baccarat or No Commission Baccarat, the commission aspect has been successfully removed. The house advantage is incorporated in a bar rule so a specific result is determined differently than with conventional Baccarat. In this context, however, the game retains a complicated draw process, does not offer higher payoffs, the tie is a non-result, and the bar rule gives an impression of a lack of balance.

SUMMARY OF THE INVENTION

There is thus a need for a Baccarat variant that not only removes the commission aspect of the game, but also eliminates card drawing complications, incorporates a house advantage in the tie result, and removes the inherent deterioration bias in conventional Baccarat. With such a Baccarat variant, the game would be simple to operate and attractive to new players.

According to the present invention, a Baccarat variant is a simplified version of the conventional game, incorporating player hand win or banker hand win bet options as well as a tie bet option. The methodology according to the invention can be applied to other ranked value games such as Blackjack, War, Dice or an original ranked value game.

According to a particular aspect of the invention, there is provided a method of playing a game where a result is determined according to ranked values. The method includes the steps of (a) receiving at least one wager that at least one of a plurality of events will occur, the plurality of events including (1) a first side having a higher ranking value than a second side, (2) the second side having a higher ranking value than the first side, and (3) the first side having a ranking value equal to the second side; (b) adjusting a house advantage by determining rules for resolving ties; (c) playing the game such that the first side and the second side each obtains results of a ranked value; and (d) resolving the at least one wager according to the ranking value results and the rules for resolving ties.

Step (c) may be practiced by dealing one or more playing cards to each of the first side and the second side. In one embodiment, playing cards having an indicia of a King, a Queen or a Jack are assigned a value of zero. In this context, in an alternative embodiment, the method may include, prior to step (a), the step of preparing a deck of the playing cards by removing cards having an indicia of a King, a Queen or a Jack. Step (c) is preferably practiced by dealing two playing cards to each of the first side and the second side and determining a numerical total of each of the two playing cards according to predetermined rules of the game. The one of the first side and the second side having a higher numerical total is declared to be the winner. Step (d) may thus be practiced by paying 1 to 1 for wagers on events (1) and (2) and paying an amount higher than 1 to 1 for wagers on event (3). For example, step (d) may be practiced by paying 8 to 1 for wagers on event (3) when the numerical total is an EVEN number and paying 9 to 1 for wagers on event (3) when the numerical total is an ODD number.

If the first side numerical total is equal to the second side numerical total, step (d) may be practiced by paying a payout for wagers on events (1) and (2) according to whether the equal numerical total falls into a first group of numerical totals or a second group of numerical totals. In this context, step (d) is practiced by paying a payout, such as 1 to 1, for wagers on events (1) and (2) when the equal first and second side numerical total falls into the second group of numerical totals and taking wagers on events (1) and (2) when the equal first and second side numerical total falls into the first group of numerical totals. Preferably, the first group of numerical totals is EVEN numbers, the second group of numerical totals is ODD numbers, and zero is considered an EVEN number.

In still another alternative, values of ten are counted as zero, and the one of the first side and the second side having a higher numerical total that is closer to nine is declared to be the winner. Step (c) may be practiced according to rules of Baccarat, Blackjack, or War or using one or more dice for each of the first side and the second side.

In accordance with another aspect of the invention, there is provided an apparatus configured for playing a game including a display, a player interface for receiving player input, and a processor configured to effect game play, the processor enabling the method according to the invention.

In accordance with yet another aspect of the invention, there is provided an apparatus configured for playing a game including a display, a player interface, and a controller receiving input from the player interface and including circuitry for effecting game play. The apparatus includes a betting unit forming part of the player interface that receives at least one wager that at least one of a plurality of events will occur. The plurality of events include (1) a first side having a higher ranking value than a second side, (2) the second side having a higher ranking value than the first side, and (3) the first side having a ranking value equal to the second side. The apparatus also includes a processing circuit that adjusts a house advantage by determining rules for resolving ties and effects play of the game such that the first side and the second side each obtains results of a ranked value. The processing circuit resolves the at least one wager according to the ranking value results and the rules for resolving ties.

In accordance with still another aspect of the invention, there is provided a game where a result is determined according to ranked values. The game includes a game table including a plurality of betting areas corresponding to the plurality of events noted above, wherein a house advantage can be adjusted according to the game by determining rules for resolving ties. The game also includes game equipment for establishing results of the first side ranking value and the second side ranking value. The game equipment may be one or more standard decks of playing cards with or without playing cards having an indicia of a King, a Queen or a Jack being removed. The game equipment may alternatively comprise dice. The game table preferably further includes a rules area setting forth rules of the game.

In accordance with another aspect of the invention, there is further provided a method of playing a game where a result is determined according to ranked values. The method includes (a) receiving at least one wager that at least one of a plurality of events will occur, the plurality of events including (1) a first side having a higher ranking value than a second side, (2) the second side having a higher ranking value than the first side, and (3) the first side having a ranking value equal to the second side; (b) playing the game such that the first side and the second side each obtains results of a ranked value; and (c) resolving the at least one wager according to the ranking value results, including a first side numerical value result and a second side numerical value result, wherein if the first side numerical value result is equal to the second side numerical value result, wagers on events (1), (2) and (3) are resolved differently according to whether the equal first and second side numerical result falls into a first group of numerical results or a second group of numerical results.

Step (c) may be practiced by paying a variable payoff for wagers on event (3) based on whether the equal first and second side numerical result falls into the first or second groups of numerical results, respectively. For example, step (c) may be practiced by paying 8 to 1 for wagers on event (3) when the equal first and second side numerical result falls into the first group of numerical results, such as EVEN numbers, and 9 to 1 when the equal first and second side numerical result falls into the second group of numerical results, such as ODD numbers. Step (c) may also be practiced by paying 1 to 1 for wagers on events (1) and (2) when the equal first and second side numerical result falls into the second group of numerical results, and taking wagers on events (1) and (2) when the equal first and second side numerical result falls into the first group of numerical results.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

Figure 1:
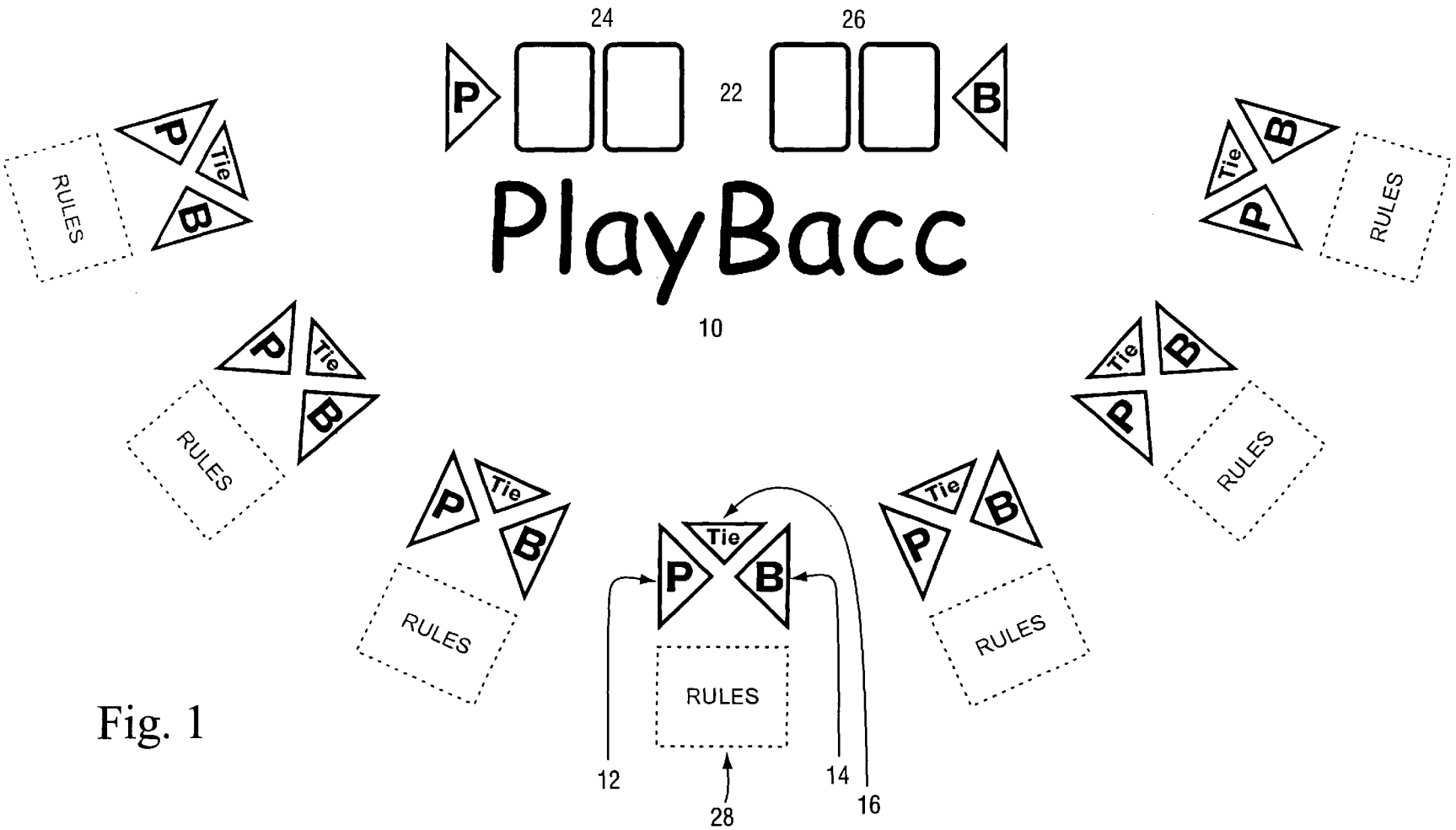
FIG. 1 is a plan view of a table arrangement according to the present invention.

FIG. 1 illustrates a playing surface or table layout 10 on which an embodiment of the invention may be played. The game according to the invention is preferably played on a semi-circular-shaped table including a host or dealer and game equipment for establishing results for a first side such as a player designated "P" and a second side such as a banker designated "B." In conventional Baccarat, one hand is designated as a player hand, and the other hand is designated as a banker hand. Participants in the game, however, can bet either for the player hand or the banker hand, which is the source of some confusion. To eliminate this confusion, according to the invention, the hands are referred to as a first side and a second side or as "P" and "B."

As shown in FIG. 1, the preferred layout includes multiple betting areas 12, 14 and 16 for one or a plurality of players. The betting areas include competition wager areas 12, 14 for simple bets that either the first side will win the hand or the second side will win the hand and a proposition wager area 16. The layout 10 also includes a dealer area 22 having two hand areas 24, 26 for the first side hand and the second side hand, respectively, and a rules area 28 setting forth one or more rules of the game.

In a preferred embodiment, the game equipment includes one or more standard decks of playing cards, such as four or eight decks, with or without picture cards being removed. In a standard deck of playing cards, picture cards include playing cards having an indicia of a King, a Queen or a Jack. The deck used in the game may be a conventional collection of multiple packs of 52 cards or alternatively a deck of 10 packs of 40 cards each with the picture cards removed. Similar to conventional Baccarat, aces count as 1, 10 cards count as zero, and 10 values in totals (e.g., a 3 card and a 7 card in a two-card hand) also count as zero. Whichever deck is used, each hand may be a two-card or three-card hand depending on the version in operation. Once the hands are dealt, there is no draw of cards thus eliminating errors, confusion and the inherent hand-deterioration bias. In a preferred embodiment, each side receives two cards, one each in alternating order.

Each player may place a bet for either side in the competition wager area 12, 14 and also may make a tie proposition bet in the proposition wager area 16. Although any rules concerning hand totals and the like can be adopted, the preferred rules for determining the winning hand preferably correspond with the rules of conventional Baccarat. That is, the hand having a higher numerical total closest to 9 is the winner.

The competition wager in areas 12 and 14 is a wager that one side or the other will win the game and preferably pays 1 to 1. A house advantage can be created with this bet for situations where the first side hand numerical total is equal to the second side hand numerical total. For example, all tied hands typically result in a pushed wager except for a tie on one or more specific numbers such as zero in which the house wins. With regular decks, zero ties may be determined as ties, losses or wins dependent upon whether the zero totals include 10-value cards. Alternatively all P and B bets may win when the tie is on any of a set of numbers, such as ODD numbers, whereas all P and B bets lose when the tie is on any of an alternative set of numbers, such a EVEN numbers, with an option for any specific numbers such as zero to be a tie or be included with either set. The house advantage changes with different sets of numbers, so a variety of sets with alternative sets may be viable. As such, the house advantage can be adjusted by determining rules with respect to resolving ties. For example, all bets in the competition wager areas 12, 14 may be paid 1 to 1 when the hands tie with a numerical total of 1, 3, 5, 7 or 9, and all bets lose on a tie with a numerical total of 0, 2, 4, 6 or 8. In another variation, the groups could be 1, 2, 3, 4 and 5, 6, 7, 8, 9, respectively, each with or without zero included or a zero value tie may be considered a push. Of course, many alternatives can be contemplated in this scenario.

In the "tie" proposition area 16, a player may wager on whether the "P" and "B" hands will result in a tie. This winning wager pays an amount higher than 1 to 1, such as 8 to 1, for example, for an EVEN tie, or 9 to 1, for example, for an ODD tie. Additional proposition wagers could encompass ties with a particular number, one hand winning by a certain numerical value, or the like.

In playing the game, the dealer preferably deals a first card to each hand area 24, 26 and then a second card to each area. The dealer then determines a numerical total and resolves the wagers according to the results of the game.

The game according to the invention is applicable to any game where a result is determined according to ranked values, such as Blackjack, War, Dice or an original ranked value game. In the dice version of the game, of course, the game equipment for establishing results of the first side ranking value and the second side ranking value includes one or more dice. The game could further be adapted to non-numerical games, provided results are determined according to some form of ranking (such as King higher than Queen or Bishop higher than Pawn or Warrior X higher than Warrior Y, etc.).

As would be apparent to those skilled in the relevant art, the invention can be embodied in a wide variety and forms of media, but not limited to, single player slot video machines, multi-player slot video machines, electronic games and devices, lottery terminals, scratch-card formats, software, as well as in-flight, home and Internet entertainment. In addition, the invention can be readily implemented as a computer program product (e.g., floppy disk, compact disk, etc.) comprising a computer readable medium having control logic recorded therein to implement the features of the invention as described in relation to the other preferred embodiments. Control logic can be loaded into the memory of a computer and executed by a central processing unit (CPU) to perform the operations described herein.

Figure 2:
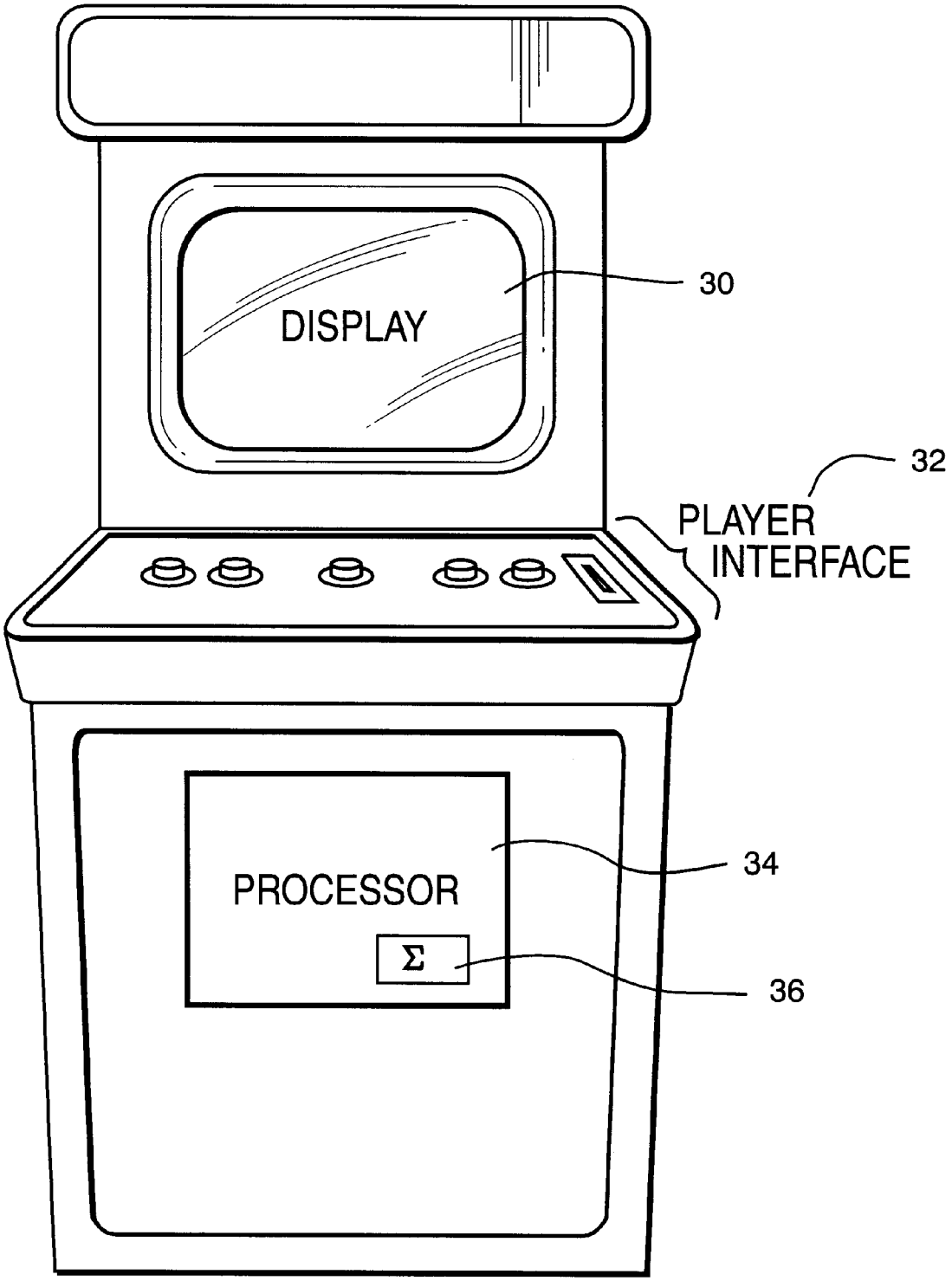
FIG. 2 is a schematic diagram illustrating the structure effecting game play according to the apparatus of the present invention.

In this context, referring to FIG. 2, a block diagram is illustrated showing the components of an apparatus configured for playing the game according to the invention. The apparatus includes a display 30, a player interface 32, and circuitry 34, 36 for effecting game play and including structure for establishing first side and second side ranking value results, such as dealing hands of cards, a summing circuit 36 that determines a ranking value of the results, and a processing circuit 34 effecting game play according to the rules of the game. The processing circuit then resolves wagers according to the ranking value results.

With the methodology according to the present invention, drawbacks associated with conventional Baccarat and the like can be eliminated, resulting in a more enjoyable and playable game that is suited for players of all levels. The elimination of card drawing rules increases the speed of play, eliminates player confusion, and avoids an inherent deterioration bias, while the casino operator can adjust a house advantage by determining rules for resolving ties.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of playing a game where a result is determined according to ranked values, the method comprising:

(a) receiving at least one wager that at least one of a plurality of events will occur, the plurality of events including (1) a first side having a higher ranking value than a second side, (2) the second side having a higher ranking value than the first side, and (3) the first side having a ranking value equal to the second side;

(b) adjusting a house advantage by determining rules for resolving wagers on events (1)–(3) when the first side has a ranking value equal to the second side;

(c) playing the game such that the first side and the second side each obtains results of a ranked value; and (d) resolving the at least one wager according to the ranking value results and the rules for resolving wagers on events (1)–(3) when the first side has a ranking value equal to the second side.

2. A method according to claim 1, wherein step (c) is practiced by dealing one or more playing cards to each of the first side and the second side.

3. A method according to claim 2, further comprising assigning playing cards having an indicia of a King, a Queen or a Jack a value of zero.

4. A method according to claim 2, further comprising, prior to step (a), preparing a deck of the playing cards by removing cards having an indicia of a King, a Queen or a Jack.

5. A method according to claim 2, wherein step (c) is practiced by dealing two playing cards to each of the first side and the second side and determining a numerical total of each of the two playing cards according to predetermined rules of the game.

6. A method according to claim 5, further comprising declaring one of the first side and the second side having a higher numerical total to be the winner.

7. A method according to claim 6, wherein step (d) is practiced by paying 1 to 1 for wagers on events (1) and (2) and paying an amount higher than 1 to 1 for wagers on event (3).

8. A method according to claim 7, wherein step (d) is practiced by paying at least 8 to 1 for wagers on event (3).

9. A method according to claim 8, wherein step (d) is practiced by paying 8 to 1 for wagers on event (3) when the numerical total is an EVEN number and paying 9 to 1 for wagers on event (3) when the numerical total is an ODD number.

10. A method according to claim 5, wherein if the first side numerical total is equal to the second side numerical total, step (d) is practiced by paying a payout for wagers on events (1) and (2) according to whether the equal first and second side numerical total falls into a first group of numerical totals or a second group of numerical totals.

11. A method according to claim 10, wherein step (d) is practiced by paying a payout for wagers on events (1) and (2) when the equal first and second side numerical total falls into the second group of numerical totals.

12. A method according to claim 11, wherein the payout is 1 to 1.

13. A method according to claim 11, wherein step (d) is practiced by taking wagers on events (1) and (2) when the equal first and second side numerical total falls into the first group of numerical totals.

14. A method according to claim 13, wherein the first group of numerical totals is EVEN numbers, the second group of numerical totals is ODD numbers, and zero is considered an EVEN number.

15. A method according to claim 5, further comprising counting values of ten as zero, and declaring one of the first side and the second side having a higher numerical total that is closer to nine to be the winner.

16. A method according to claim 1, wherein step (c) is practiced according to rules of Baccarat.

17. A method according to claim 1, wherein step (c) is practiced according to rules of Blackjack.

18. A method according to claim 1, wherein step (c) is practiced according to rules of War.

19. A method according to claim 1, wherein step (c) is practiced using one or more dice for each of the first side and the second side.

20. A method of playing a game where a result is determined according to ranked values, the method comprising:

(a) receiving at least one wager that at least one of a plurality of events will occur, the plurality of events including (1) a first side having a higher ranking value than a second side, (2) the second side having a higher ranking value than the first side, and (3) the first side having a ranking value equal to the second side;

(b) playing the game such that the first side and the second side each obtains results of a ranked value; and (c) resolving the at least one wager according to the ranking value results, including a first side numerical value result and a second side numerical value result, wherein if the first side numerical value result is equal to the second side numerical value result, wagers on events (1), (2) and (3) are resolved differently according to whether the equal first and second side numerical result falls into a first group of numerical results or a second group of numerical results.

21. A method according to claim 20, wherein step (c) is practiced by paying a variable payoff for wagers on event (3) based on whether the equal first and second side numerical result falls into the first or second groups of numerical results, respectively.

22. A method according to claim 21, wherein step (c) is practiced by paying 8 to 1 for wagers on event (3) when the equal first and second side numerical result falls into the first group of numerical results and 9 to 1 when the equal first and second side numerical result falls into the second group of numerical results.

23. A method according to claim 22, wherein the first group of numerical results comprises EVEN numbers, the second group of numerical results comprises ODD numbers, and zero is considered an EVEN number.

24. A method according to claim 20, wherein the first group of numerical results comprises EVEN numbers, the second group of numerical results comprises ODD numbers, and zero is considered an EVEN number.

25. A method according to claim 24, wherein step (c) is practiced by paying 1 to 1 for wagers on events (1) and (2) when the equal first and second side numerical result falls into the second group of numerical results.

26. A method according to claim 25, wherein step (c) is practiced by taking wagers on events (1) and (2) when the equal first and second side numerical result falls into the first group of numerical results.

27. A method according to claim 20, wherein step (c) is practiced by paying a payout for wagers on events (1) and (2) when the equal first and second side numerical result falls into the second group of numerical results.

28. A method according to claim 27, wherein step (c) is practiced by taking wagers on events (1) and (2) when the equal first and second side numerical result falls into the first group of numerical results.

* * * * *